US008106863B2

(12) United States Patent
Huang

(10) Patent No.: US 8,106,863 B2
(45) Date of Patent: Jan. 31, 2012

(54) COMMON VOLTAGE GENERATING CIRCUIT HAVING SQUARE WAVE GENERATING UNIT AND LIQUID CRYSTAL DISPLAY USING SAME

(75) Inventor: Shun-Ming Huang, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 826 days.

(21) Appl. No.: 12/215,583

(22) Filed: Jun. 27, 2008

(65) Prior Publication Data

US 2009/0002306 A1 Jan. 1, 2009

(30) Foreign Application Priority Data

Jun. 29, 2007 (CN) ..... 2007 1 0076254

(51) Int. Cl.
*G09G 3/36* (2006.01)

(52) U.S. Cl. ..... 345/87; 345/98

(58) Field of Classification Search ..... 345/87–103
See application file for complete search history.

(56) References Cited

U.S. PATENT DOCUMENTS 6,822,884 B1 * 11/2004 Rosenthal et al. ..... 363/59
7,138,996 B2 11/2006 Lee et al.
2007/0146271 A1 * 6/2007 Park ..... 345/89

FOREIGN PATENT DOCUMENTS

CN 1499478 A 5/2004

* cited by examiner

*Primary Examiner* — Chanh Nguyen
*Assistant Examiner* — Charles Zheng
(74) *Attorney, Agent, or Firm* — Altis Law Group, Inc.

(57) ABSTRACT

A common voltage generating circuit includes a square wave generating unit, a diode, a NOT gate, a first capacitor, a second capacitor, a third capacitor, a first resistor, a second resistor, and an output terminal. The square wave generating unit includes an output terminal, which is coupled to the output terminal of the common voltage generating circuit via the first resistor, a positive terminal of the diode, a negative terminal of the diode, and the second resistor in series. The output terminal of the square wave generating unit is coupled to the negative terminal of the diode via the NOT gate and the first capacitor. The positive terminal of the diode is grounded via the second capacitor, and the output terminal of the common voltage generating circuit is grounded via the third capacitor. A duty ratio of the output square wave generating unit is capable of being modulated.

13 Claims, 3 Drawing Sheets

COMMON VOLTAGE GENERATING CIRCUIT HAVING SQUARE WAVE GENERATING UNIT AND LIQUID CRYSTAL DISPLAY USING SAME

FIELD OF THE INVENTION

Embodiments of the present disclosure relate to common voltage generating circuits, and more particularly to a common voltage generating circuit for a liquid crystal display (LCD).

GENERAL BACKGROUND

LCDs are widely used in various modern electronics, such as notebook computers, personal digital assistants, and video cameras, for example. In general, an LCD includes a voltage generating circuit to provide a common voltage for the LCD. Precise common voltage adjustments may be made to the LCD to improve a display quality of the LCD.

FIG. 5 shows one embodiment of a conventional common voltage generating circuit 20 used in an LCD. In the embodiment of FIG. 5, the common voltage generating circuit 20 includes a controller 210, a plurality of resistors 220, and a plurality of switches 230. The resistors 220 are electrically coupled in series, and cooperatively constitute a resistor-string to form a voltage divider. A voltage output 231 is configured to provide a common voltage for a liquid crystal panel (not shown) of the LCD.

Typically, the voltage generating circuit 20 is large in size and complicated due to the numerous resistors 220. Additionally, the voltage generating circuit 20 may not output precise common voltage adjustments to the LCD due to the voltage generating circuit 20 having a finite number of resistors 220. The finite number of resistors 220 limits a number of possible voltage outputs for the voltage output 231. Accordingly, when a common voltage, with low precision adjustments, is applied to the LCD, a display quality of the LCD may be perceived as being of a low quality.

It is, therefore, desired to provide a common voltage generating circuit and an LCD using the common voltage generating circuit which can overcome the above-described deficiencies.

SUMMARY

In one aspect, a common voltage generating circuit includes a square wave generating unit, a diode, a NOT gate, a first capacitor, a second capacitor, a third capacitor, a first resistor, a second resistor, and an output terminal. The square wave generating unit includes an output terminal, which is coupled to the output terminal of the common voltage generating circuit via the first resistor, a positive terminal of the diode, a negative terminal of the diode, and the second resistor in series. The output terminal of the square wave generating unit is coupled to the negative terminal of the diode via the NOT gate and the first capacitor. The positive terminal of the diode is grounded via the second capacitor, and the output terminal of the common voltage generating circuit is grounded via the third capacitor. A duty ratio of the output by the square wave generating unit is capable of being modulated.

In another aspect, a liquid crystal display device includes a liquid crystal panel and a backlight module for illuminating the liquid crystal panel. The liquid crystal panel has a first substrate, a second substrate, a liquid crystal layer interposed between the first and second substrates, a common electrode disposed at an inner surface of the first substrate, and a common voltage generating circuit for providing common voltage signals to the common electrode. The common voltage generating circuit includes a square wave generating unit, a diode, a NOT gate, a first capacitor, a second capacitor, a third capacitor, a first resistor, a second resistor, and a common voltage output terminal. The square wave generating unit includes an output terminal, which is coupled to the common voltage output terminal via the first resistor, a positive terminal of the diode, a negative terminal of the diode, and the second resistor in series. The output terminal of the square wave generating unit is coupled to the negative terminal of the diode via the NOT gate and the first capacitor. The positive terminal of the diode is grounded via the second capacitor, and the common voltage output terminal is grounded via the third capacitor. A duty ratio of the output by the square wave generating unit is capable of being modulated.

In a further aspect, a liquid crystal display device includes a liquid crystal panel and a backlight module for illuminating the liquid crystal panel. The liquid crystal panel has a first substrate, a second substrate, a liquid crystal layer interposed between the first and second substrates, a common electrode disposed at an inner surface of the first substrate, and a common voltage generating circuit for providing common voltage signals to the common electrode. The common voltage generating circuit includes a square wave generating unit, a charge pump circuit, and a filter circuit. The square wave generating unit provides a square wave signal that is capable of being modulated, and the charge pump circuit generates and outputs a desired voltage signal according to a duty ratio of the square wave signal. Then the filter circuit filters and smoothes the voltage signal so as to generate a common voltage signal.

Other novel features and advantages will become more apparent from the following detailed description when taken in conjunction with the accompanying drawings.

DETAILED DESCRIPTION OF CERTAIN INVENTIVE EMBODIMENTS

Reference will now be made to the drawings to describe certain inventive embodiments of the present disclosure.

Figure 1:
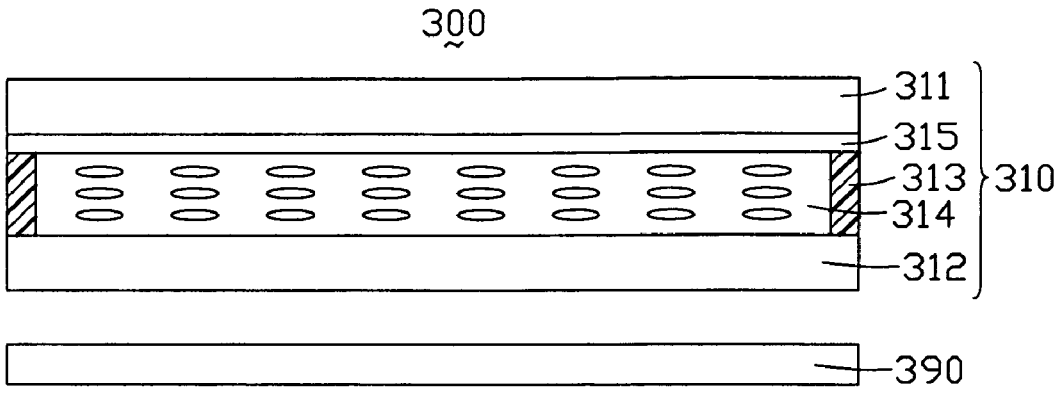
FIG. 1 is an isometric, side view of one embodiment of an LCD of the present disclosure comprising a second substrate.

Referring to FIG. 1, an LCD 300 according to one embodiment of the present disclosure is shown. The LCD 300 includes a liquid crystal panel 310 and a backlight module 390 for illuminating the liquid crystal panel 310.

The liquid crystal panel 310 includes a first substrate 311, a second substrate 312, a sealant 313, and a liquid crystal layer 314. The first substrate 311 is disposed generally opposite to the second substrate 312, and the sealant 313 is disposed between and cooperates with the first and second substrates 311, 312 to form a receiving space therebetween. The liquid crystal layer 314 is contained in the receiving space. A common electrode 315 is disposed at an inner surface of the first substrate 311 adjacent to the liquid crystal layer 314. In one embodiment, the common electrode 315 may be made of indium-tin-oxide.

Figure 2:
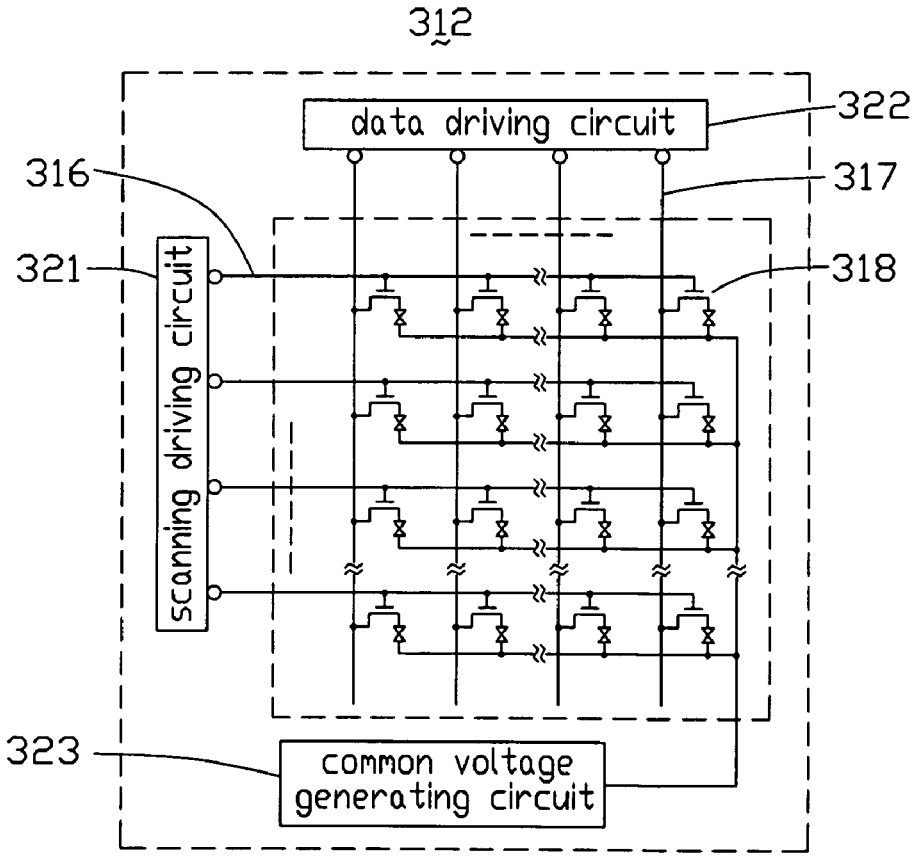
FIG. 2 is a partial circuit diagram of one embodiment of the second substrate of the LCD in FIG. 1, the LCD comprising a common voltage generating circuit.

FIG. 2 is a partial circuit diagram of one embodiment of the second substrate 312. The second substrate 312 includes a plurality of rows of parallel scanning lines 316, a plurality of columns of parallel data lines 317 perpendicular to the scanning lines 316, a plurality of thin film transistors (TFTs) 318 each disposed near an intersection of a corresponding one of the scanning lines 316 and a corresponding one of the data lines 317, and a plurality of pixel electrodes (not labeled). Each of the TFTs 318 corresponds to one of the pixel electrodes, and a gate electrode of the TFT 318 is electrically coupled to the corresponding scanning line 316. Further, a source electrode of the TFT 318 is electrically coupled to the corresponding data line 317, and a drain electrode of the TFT 318 is electrically coupled to the corresponding pixel electrode.

The second substrate 312 also includes a scanning driving circuit 321, a data driving circuit 322, and a common voltage generating circuit 323. The scanning driving circuit 321 is coupled to the scanning lines 316, and the data driving circuit 322 is coupled to the data lines 317. The common voltage generating circuit 323 is coupled to the common electrode 315 (as shown in FIG. 1), and provides a common voltage to the common electrode 315.

Figure 3:
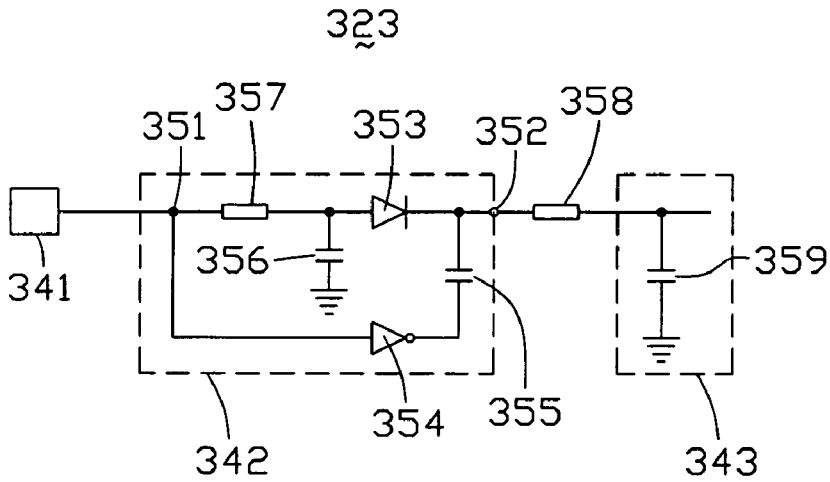
FIG. 3 is a circuit diagram of one embodiment of the common voltage generating circuit of FIG. 2.

FIG. 3 illustrates a schematic of one embodiment of the common voltage generating circuit 323, which includes a square wave generating unit 341, a charge pump circuit 342, and a filter circuit 343 connected in series.

In one embodiment, the charge pump circuit 342 includes an input terminal 351, an output terminal 352, a diode 353, a NOT gate 354, a first capacitor 355, a second capacitor 356, and a first resistor 357. The input terminal 351 is coupled to the output terminal 352 via the NOT gate 354 and the first capacitor 355, and is also coupled to the output terminal 352 via the first resistor 357, a positive terminal of the diode 353, and a negative terminal of the diode 353 in series. The positive terminal of the diode 353 is grounded via the second capacitor 356.

The filter circuit 343, in one embodiment, includes a second resistor 358 and a third capacitor 359. An input terminal (not labeled) of the filter circuit 343 is coupled to an output terminal of the filter circuit 343 via the second resistor 358, and the output terminal of the filter circuit 343 is grounded via the third capacitor 359.

In one embodiment, the square wave generating circuit 341 may output a square wave signal with a fixed frequency, and the duty ratio of the square wave signal may be modulated by the square wave generating circuit 341. However, it may be understood that depending on the embodiment, the square wave generating circuit may be replaced by a wave generating circuit capable of generating a sine wave or a triangle wave, for example. It may be understood that the square wave signal has a high level voltage and a low level voltage with both the high level voltage and the low level voltage in substantially a square-shaped waveform. In one embodiment, the duty ratio may be defined as a ratio between a pulse duration and a period of a square waveform.

The input terminal 351 of the charge pump circuit 342 receives a square wave signal from the square wave generating circuit 341, causing the output terminal 352 of the charge pump circuit 342 to generate and output voltage signals according to a high level voltage and a low level voltage (0 V) of the square wave signal. The outputted voltage signals are smoothed by the filter circuit 343, so as to generate a common voltage. Thus, a duty ratio of the square wave signal may be modulated in order to provide a predetermined common voltage for the LCD 300.

In one embodiment, the common voltage generating circuit 323 operates as follows. When the square wave generating unit 341 outputs a high level voltage Vm, the NOT gate 354 outputs a low level voltage of about 0 V. In this situation, a voltage of the first capacitor 355 is invariable, thereby causing the negative terminal of the diode 353 to be set as about 0 V and the positive terminal of the diode to be set as the voltage Vm. In this particular situation, the diode 353 is switched on so as to charge the first capacitor 355 to a voltage Vl. That is, the voltage of the output terminal 352 is the voltage Vl.

When the square wave generating unit 341 outputs a low level voltage of 0 V, the NOT gate 354 outputs a high level voltage Vm. In this situation, a voltage of the first capacitor 355 is invariable, thereby causing the negative terminal of the diode 353 to be set as a voltage Vm+Vl. That is, the voltage of the output terminal 352 is Vm+Vl, and the first capacitor 355 starts to discharge.

In a next time period, the common voltage generating circuit 323 repeats the above-mentioned operation process. The voltage of the output terminal 352 is smoothed by the filter circuit 343, so as to generate the common voltage.

A charging time of the first capacitor 355 can be adjusted via modulating the duty ratio of the square wave signal generated by the square wave voltage generating unit 341. Therefore, the voltage Vl of the first capacitor 355 may be adjusted at a value large than 0 V and less than or equal to Vm via modulating the duty ratio of the square wave signal.

In summary, the common voltage generating circuit 323 may be installed in the LCD 300 to generate a predetermined common voltage via modulating a duty ratio of the square wave generating unit 341. Accordingly, the common voltage generating circuit 323 does not require many resistors, thus making the common voltage generating circuit 323 compact and simple. Moreover, because the duty ratio of the square wave generating unit 341 can be adjusted according to different systems, adjustments to the common voltage may be made with a higher precision. Therefore, by employing the common voltage generating circuit 323, a display quality of the LCD 300 is improved.

Figure 4:
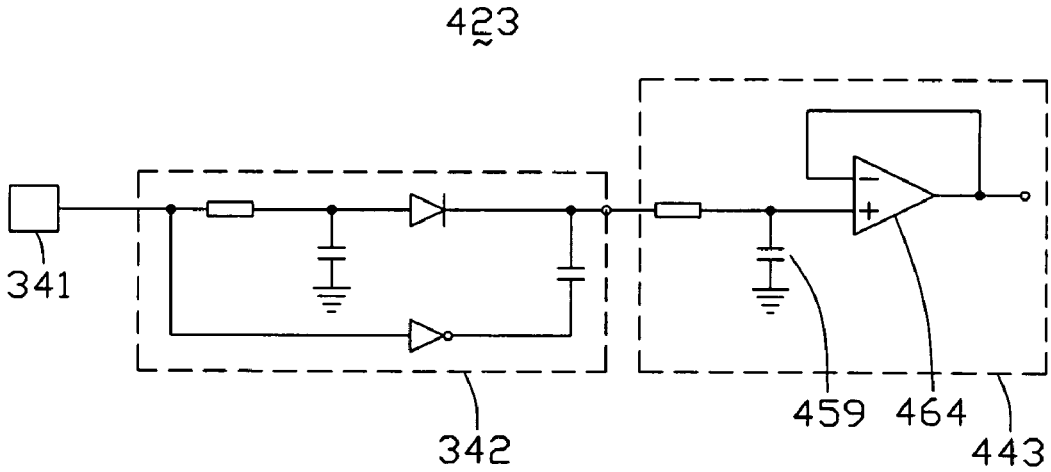
FIG. 4 is a circuit diagram of another embodiment of a common voltage generating circuit of FIG. 2.
Figure 5:
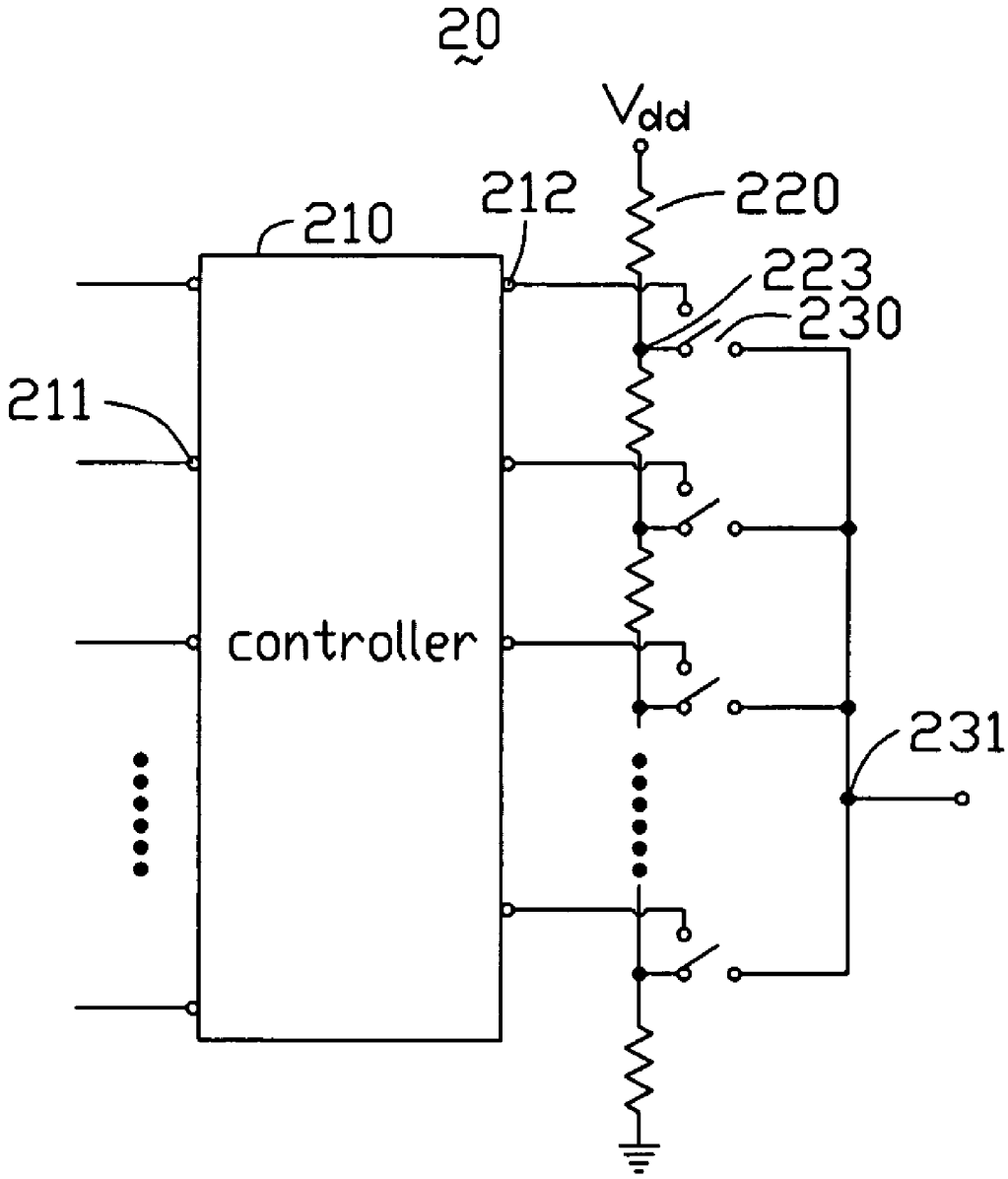
FIG. 5 (RELATED ART)
FIG. 5 shows one embodiment of a conventional common voltage generating circuit used in an LCD.

FIG. 4 is a circuit diagram of another embodiment of a common voltage generating circuit 423 of the LCD in FIG. 1. In one embodiment, the common voltage generating circuit 423 includes a filter circuit 443, the square wave generating unit 341 and the charge pump circuit 342 connected in series. In one embodiment, the filter circuit 443 includes an amplifier 464, with a positive terminal of the amplifier 464 grounded via a third capacitor 459, and an output terminal of the amplifier 464 coupled to a negative terminal of the amplifier 464. The output terminal of the amplifier 464 serves as an output terminal of the filter circuit 443. The amplifier 464 serves as a voltage follower, which can improve the load ability of the common voltage generating circuit 423. In one embodiment, the amplifier 464 may include an operational amplifier, for example.

It is to be understood that even though numerous characteristics and advantages of certain embodiments of the present disclosure have been set out in the foregoing description, the disclosure is illustrative only, and changes may be made in detail (including in matters of arrangement of parts) within the principles of the invention to the full extent indicated by the broad general meaning of the terms in which the appended claims are expressed.

What is claimed is:

1. A common voltage generating circuit, comprising:

a wave generating unit, a diode, a NOT gate, a first capacitor, a second capacitor, a third capacitor, a first resistor, a second resistor, and an output terminal;

wherein the wave generating unit comprises an output terminal coupled to the output terminal of the common voltage generating circuit via the first resistor, a positive terminal of the diode, a negative terminal of the diode, and the second resistor in series; the output terminal of the wave generating unit is coupled to the negative terminal of the diode via the NOT gate and the first capacitor; the positive terminal of the diode is capable of being grounded via the second capacitor, and the output terminal of the common voltage generating circuit is grounded via the third capacitor; and wherein a wave signal is generated by the wave generating unit and configured to alternately switch on and switch off the diode, the first capacitor is directly charged by the wave signal via a cooperation of the diode and NOT gate, a duty ratio of the wave signal from the wave generating unit is capable of being modulated, and a charging time of the first capacitor is adjustable by modulating the duty ratio of the wave signal.

2. The common voltage generating circuit of claim 1, further comprising a voltage follower coupled to the output terminal of the common voltage generating circuit.

3. The voltage generating circuit of claim 2, wherein the voltage follower comprises an amplifier, a positive terminal of the amplifier is coupled to the output terminal of the common voltage generating circuit, and a negative terminal of the amplifier is coupled to an output terminal of the amplifier.

4. The common voltage generating circuit of claim 1, wherein the wave signal generated by the wave generating unit is at least one item selected from the group consisting of a square wave signal, a sine wave signal and a triangle wave signal.

5. A liquid crystal display device, comprising:

a liquid crystal panel comprising a first substrate, a second substrate, a liquid crystal layer interposed between the first and second substrates, a common electrode disposed at an inner surface of the first substrate, and a common voltage generating circuit for providing common voltage signals to the common electrode; and a backlight module positioned for illuminating the liquid crystal panel;

wherein the common voltage generating circuit comprises a wave generating unit, a diode, a NOT gate, a first capacitor, a second capacitor, a third capacitor, a first resistor, a second resistor, and a common voltage output terminal; the wave generating unit comprises an output terminal coupled to the common voltage output terminal via the first resistor, a positive terminal of the diode, a negative terminal of the diode, and the second resistor in series; the output terminal of the wave generating unit is coupled to the negative terminal of the diode via the NOT gate and the first capacitor; the positive terminal of the diode is capable of being grounded via the second capacitor, and the common voltage output terminal is capable of being grounded via the third capacitor; and wherein a wave signal generated by the wave generating unit is configured to alternatively switch on and switch off the diode and charge the first capacitor via the diode and NOT gate respectively, a duty ratio of the wave signal from the wave generating unit is capable of being modulated, and a charging time of the first capacitor is adjustable by modulating the duty ratio of the wave signal.

6. The liquid crystal display device of claim 5, further comprising a voltage follower coupled to the common voltage output terminal.

7. The liquid crystal display device of claim 6, wherein the voltage follower comprises an amplifier, a positive terminal of the amplifier is coupled to the common voltage output terminal, and a negative terminal of the amplifier is coupled to an output terminal of the amplifier.

8. The liquid crystal display device of claim 5, wherein the wave signal generated by the wave generating unit is at least one item selected from the group consisting of a square wave signal, a sine wave signal and a triangle wave signal.

9. A liquid crystal display device, comprising:

a liquid crystal panel comprising a first substrate, a second substrate, a liquid crystal layer interposed between the first and second substrates, a common electrode disposed at an inner surface of the first substrate, and a common voltage generating circuit configured for providing common voltage signals to the common electrode; and a backlight module positioned for illuminating the liquid crystal panel;

wherein the common voltage generating circuit comprises a wave generating unit, a charge pump circuit, and a filter circuit; the charge pump circuit comprises an input terminal, an output terminal, a diode, a first capacitor, a second capacitor, a first resistor, and a NOT gate; the input terminal of the charge pump circuit is coupled to the output terminal of the charge pump circuit via the first resistor, a positive terminal of the diode, and a negative terminal of the diode in series; the input terminal of the charge pump circuit is coupled to the negative terminal of the diode via the NOT gate and the first capacitor; and the positive terminal of the diode is capable of being grounded via the second capacitor; the wave generating unit is configured to provide a wave signal that is capable of being modulated, the wave signal generated by the wave generating unit is configured to alternatively switch on and switch off the diode and charge the first capacitor via the diode and NOT gate respectively, and a charging time of the first capacitor is adjustable by modulating a duty ratio of the wave signal; the charge pump circuit is configured to generate and output a desired voltage signal according to the duty ratio of the wave signal, and the filter circuit is configured to filter and smooth the voltage signal so as to generate a common voltage signal.

10. The liquid crystal display device of claim 9, wherein the filter circuit comprises an input terminal, an output terminal, a third capacitor, and a second resistor; the input terminal of the filter circuit is coupled to the output terminal of the filter circuit via the second resistor and is capable of being grounded via the third capacitor.

11. The liquid crystal display device of claim 9, further comprising a voltage follower coupled to the output terminal of the filter circuit.

12. The liquid crystal display device of claim 11, wherein the voltage follower comprises an amplifier, a positive terminal of the amplifier is coupled to the output terminal of the filter circuit and a negative terminal of the amplifier are coupled to an output terminal of the amplifier.

13. The liquid crystal display device of claim 9, wherein the wave signal generated by the wave generating unit is at least one item selected from the group consisting of a square wave signal, a sine wave signal and a triangle wave signal.

* * * * *